United States Patent [19]

Hutton et al.

[11] 4,044,487

[45] Aug. 30, 1977

[54] ROTARY PORT COVER

[75] Inventors: James C. Hutton, Mohawk; Thomas G. Bauman, Ilion; Kenneth C. Rowlands, Utica, all of N.Y.

[73] Assignee: Remington Arms Company, Inc., Bridgeport, Conn.

[21] Appl. No.: 690,518

[22] Filed: May 27, 1976

[51] Int. Cl.[2] ..... F41C 27/08

[52] U.S. Cl. ..... 42/16

[58] Field of Search ..... 42/16

[56] References Cited

U.S. PATENT DOCUMENTS

| | | | |
|---|---|---|---|
| 1,413,109 | 4/1922 | Feederle | 42/16 |
| 2,288,202 | 6/1942 | Mossberg | 42/16 |
| 2,648,153 | 8/1953 | Dicke | 42/16 |
| 2,940,201 | 6/1960 | Reed | 42/16 |
| 3,030,722 | 4/1962 | Ivy | 42/16 |
| 3,318,192 | 5/1967 | Miller et al. | 42/16 |
| 3,368,298 | 2/1968 | Browning | 42/16 |
| 3,619,926 | 11/1971 | Alday | 42/16 |

*Primary Examiner*—Charles T. Jordan

*Attorney, Agent, or Firm*—John H. Lewis, Jr.; Nicholas Skovran; William L. Ericson

[57] ABSTRACT

An ejection port cover for a firearm which moves in pure rotation about an axis parallel to the bore of the firearm. The port cover is held about this axis and is oriented in the "open port" and "closed port" rotational position for proper alignment of a port cover cam with associated cam pin means on the reciprocating slide assembly since the port cover is shorter than the stroke of the slide assembly that engages and causes rotation of the port cover.

31 Claims, 18 Drawing Figures

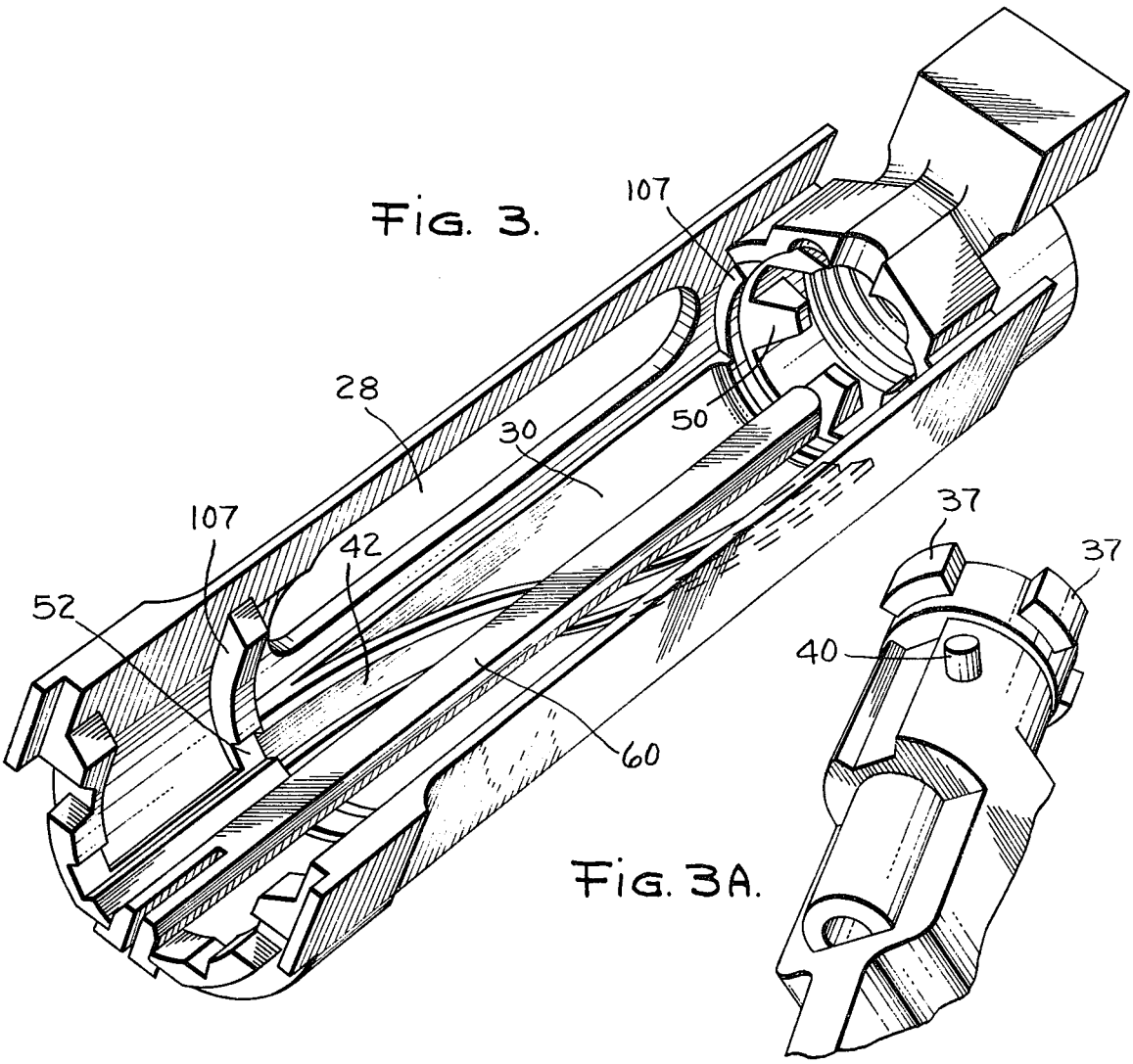
Fig. 3.
Fig. 3A.
Fig. 4.
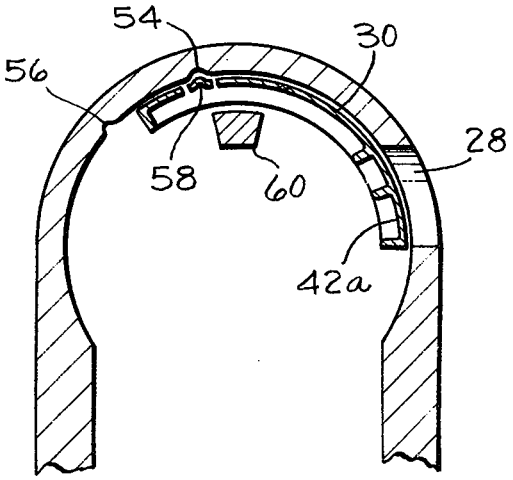
Fig. 5.
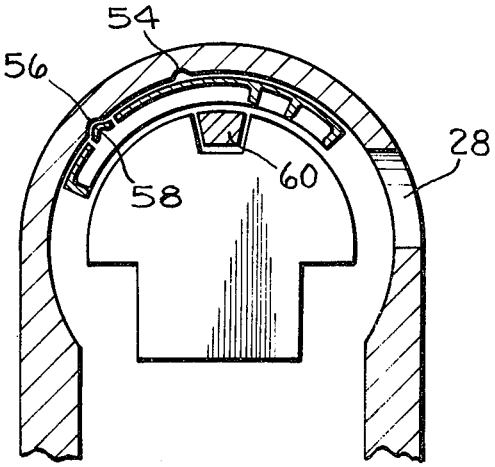

ROTARY PORT COVER

The present invention relates to an ejection port cover which acts to uncover and cover the ejection port of a firearm by moving in a purely rotational manner about an axis parallel to the longitudinal axis of the firearm. More particularly, the invention relates to an ejection port cover which is actuated by cam means on the port cover and the reciprocating bolt assembly to move in pure rotation from a port closed position (when the bolt assembly is in the breech locking position) to a port open position (when the bolt assembly is in the breech open position).

The purpose of an ejection port cover is to cover the ejection port in a firearm receiver when spent cartridge ejection is not taking place, thereby preventing dust or other foreign material from entering the closed firearm action. In sporting firearms, the style and appearance of the port cover are also important.

Most semiautomatic and slide action sporting firearms currently produced use a receiver of the enclosed type, i.e. the receiver is machined or formed to totally enclose the reciprocating breach bolt assembly. Typically, an ejection port opening is machined into the side of the receiver rearward of the chamber to provide an opening through which the spent casing is discarded as the breech bolt assembly moves rearward.

Firearms for firing rim fire ammunition generally do not use an ejection port cover because the port opening is quite small in relation to the reciprocating parts and can therefore be effectively closed by them. Shotguns do not generally use an ejection port cover either, because the ejection port opening is necessarily quite large and therefore difficult to close effectively. Most shotguns simply use the breech bolt or the bolt carrier to partially close the ejection port.

Prior art port covers, thus, are found primarily, although not exclusively, in "center fire" rifles. There are various types shown in the patented prior art:

1. "Hinged" covers as shown in U.S. Pat. No. 2,940,201 issued to F.P. Reed on June 14, 1960, and U.S. Pat. No. 3,030,722 issued to J.T. Ivy on Apr. 24, 1962;

2. "Sliding" or telescoping covers as shown in U.S. Pat. No. 2,341,767 issued to G. R. Gans on Feb. 15, 1944, U.S. Pat. No. 2,685,754 issued to L. R. Crittendon et al on Aug. 10, 1954, and U.S. Pat. No. 3,368,298 issued to B.W. Browning on February 13, 1968; and

3. "Rotating" or combination telescoping-rotating cover as shown in U.S. Pat. No. 3,619,926, issued to J. M. Alday on Nov. 16, 1971.

The most pertinent patent, as it relates to the present invention, is the Alday patent, which is assigned to the present Assignee. Although the patent does mention a purely rotative port cover, the drawing discloses a port cover which slides rearward with the bolt carrier for most of the rearward stroke until the port cover is stopped by an abutment on the receiver. At this point, the cam pin moves through the "dog leg" portion of the cam track to cause rotation of the port cover. The abrupt "dog leg" cam form is employed to create a distinct mechanical disadvantage of the cam pin in the port cover track, so that rotation occurs only at the rear of the port cover stroke when the abutment is encountered.

The ejection port cover of the present invention is in the form of a segment of a hollow cylinder. It is positioned in a mating cylindrical recess in the upper interior of a firearm receiver and is restrained from longitudinal movement by abutment surfaces at the front and rear. Rotary motion of the port cover is caused by the action of a cam pin located on the bolt carrier (or other part of the bolt assembly), as it moves longitudinally, acting on a cam track formed on the underside or inside surface of the port cover. A longitudinally extending retaining rail is detachably connected to the receiver so as to retain the port cover in position while permitting it to rotate in place.

It is an object of the present invention to provide a port cover that moves in a purely rotational manner to cover or uncover an ejection port of a firearm.

It is another object of the invention to provide a cam track design which provides for complete rotation of the port cover at a low stress level and which accelerates and decelerates the port cover to cover and uncover the ejection port in a smooth manner.

It is still another object of the invention to provide a rotational port cover which does not move longitudinally relative to the receiver thus permitting the use of a shorter receiver.

It is still another object of the invention to provide a port cover for a break open firearm where the receiver is comprised of two spearable members, i.e. a barrel extension constituting the top front portion and a frame constituting the rear and lower portion.

Other objects and advantages will become apparent from the following description taken in conjunction with the accompanying drawing in which:

FIG. 1 is an elevational view of a break open gun in its hinged-open position showing the bolt assembly in the rear position on the gun frame and the rotatable port cover in the "open port" position in the barrel extension portion of the barrel assembly and the position of the cam track exaggerated somewhat to show its general position.

FIG. 2 is a side view of the break open gun of FIG. 1 with the barrel assembly down in the locked position, the bolt assembly in the forward, breech closed position and the port cover rotated so as to close the ejection port opening. The cam track is shown in dotted lines to indicate that it is on the inside of the port cover and on the side of the barrel extension closest to the viewer when looking at FIG. 2.

FI. 3 is an isometric view of a rifle barrel extension and port cover in an upside down position so as to show the various elements more clearly. It should be noted that the port opening is narrow and completely formed in the extension indicating that it is used for a rifle rather than the wide opening shown in the shotgun barrel extension in FIGS. 1 and 2. The port cover is in the "open port" position.

FIG. 3A is an isometric view of a rifle bolt carrier assembly in its right-side-up position which is slidably positioned in the barrel extension shown in FIG. 3.

FIG. 4 is a cross-sectional end view through a firearm receiver or barrel extension (leaving out details of the sliding bolt assembly for clarity) showing the port cover rotated to cover the ejection port opening.

FIG. 5 is a view similar to FIG. 4 in which the port cover has been rotated out of port covering position.

Figure 1:
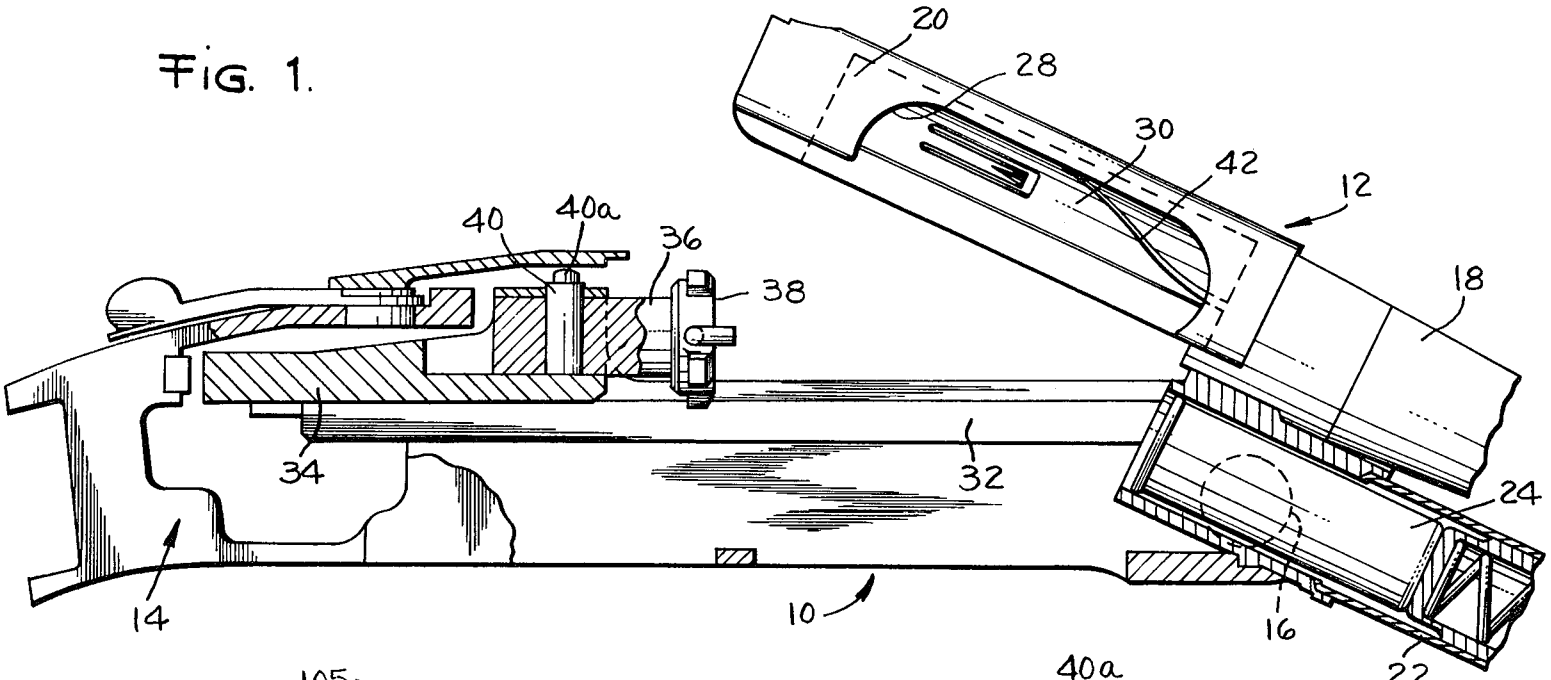
FIG. 1 shows the invention used in a break open shotgun. However, it should be understood that the invention can also be used in break open rifles, as well as shotguns and rifles having conventional one-piece enclosed type receivers which totally enclose the reciprocating mechanism.
Figure 2:
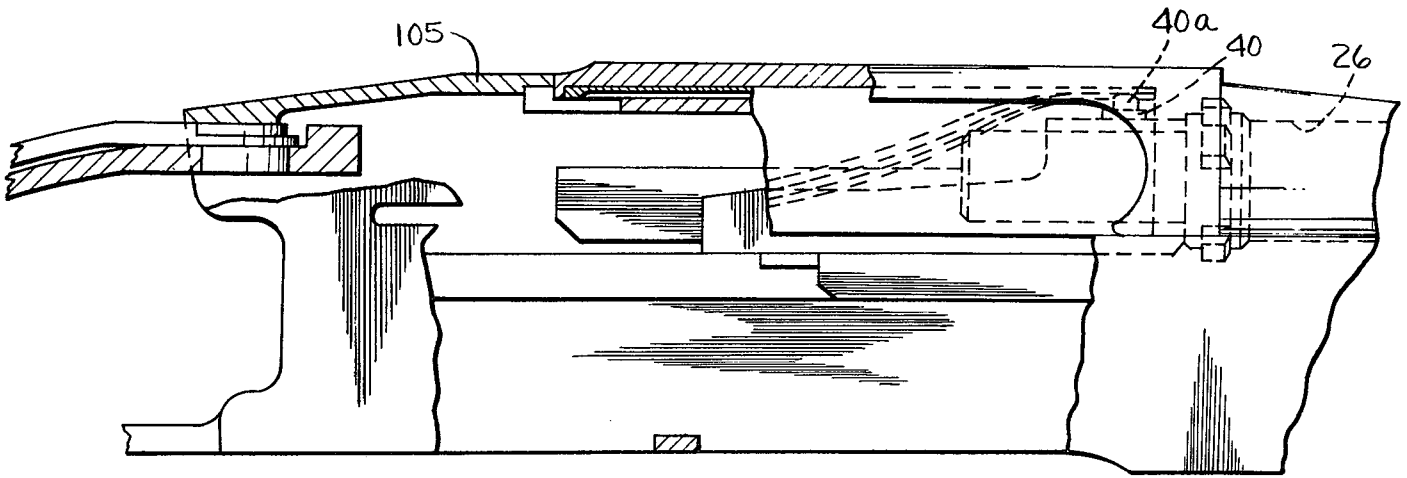

The firearm 10 in FIG. 1 shows a barrel assembly 12 separably connected to and hinged to a frame 14 by means of a pivot 16. Since the present invention does not involve the pivot 16 and since the patented art shows various ways in which the barrel assembly can be hinged to the frame, exact details of pivot 16 are not shown in this case. The barrel assembly 12 includes a barrel 18 and a barrel extension 20 attached to the rear end thereof. Attached to the bottom of the barrel 18 is a magazine tube assembly 22 in which one or more cartridges 24 are stored prior to being fed into the gun chamber 26 (FIG. 2). The barrel extension 20 has an ejection port opening 28 through which spent cartridges are ejected in a conventional manner after firing, and also through which unfired cartridges can be fed into the chamber. A port cover 30 is rotatably mounted in said barrel extension in a manner to be explained below.

The frame 14, together with the barrel extension 20, form a receiver assembly when they are locked together as shown in FIG. 2, the barrel extension forming the upper forward portion of the receiver assembly and the frame forming the rear lower portion thereof.

FIG. 1 also shows action bars 32 which are connected at their rear by a bolt carrier 34. A reciprocating bolt 36 is mounted in the carrier 34 to move from a rear, breech open position to a forward breech closed position where the bolt head 38 is rotated by a cam pin 40 and slot means (not shown) to lock the bolt head to the barrel assembly. This rotating bolt feature, effected by a cam pin and slot, is not new and is found in the patented art. See, for example, the Browning U.S. Pat. No. 3,368,298, cited above.

The slide action assembly comprised of action bars 32, associated bolt carrier 34 and bolt 36 can be part of a semiautomatic, e.g. a gas operated, system or a manually operated, e.g. a pump action, firearm. After firing, the slide action assembly is moved rearwardly, either by gas pressure or manually, whereupon the bolt head 38 is rotated out of locked firing position and then the entire assembly is moved axially to the rear position shown in FIG. 1. When it is desired to load a cartridge into the chamber and to lock the bolt head preparatory to firing, the action slide assembly is moved forwardly until the bolt head approaches the forward breech-closed position whereupon the cam pin and cam slot interact to rotate the bolt head to lock the head to the barrel assembly (see FIG. 2). For a more detailed description of this aspect of the operation, see copending application Serial No. 641,962 filed by Thomas G. Bauman, et al on Dec. 18, 1975, now Pat. No. 3,996,684.

The cam pin 40, shown in FIG. 1, has an upward protuberance 40*a* which has a slot 40*b* therein (see FIG. 6) to form a female type end that is engaged by a male type helical cam track 42*a* formed on the inside wall of the port cover 30.

Figure 6:
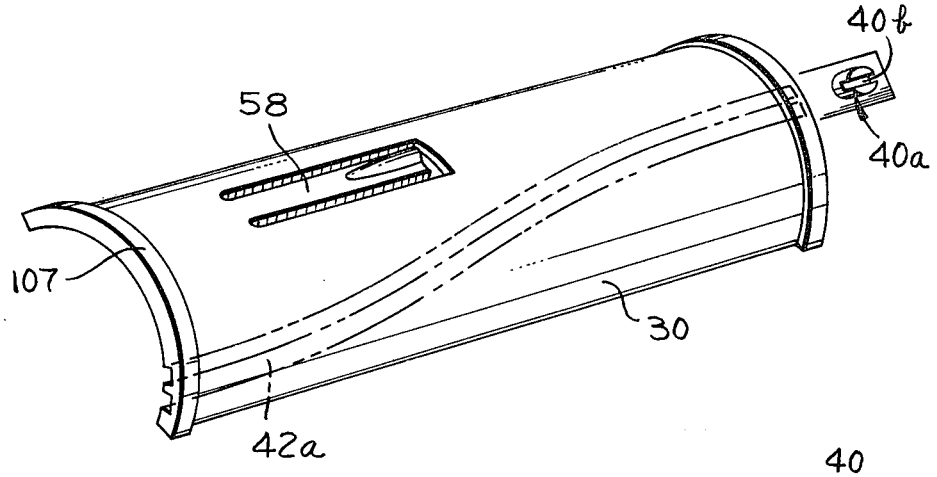
FIG. 6 is an isometric view of a port cover having a male cam track and a female type cam pin which cooperates with the cam track to rotate the port cover.

As further shown in FIG. 6, the port cover 30 is in the form of a segment of a hollow cylinder. It is positioned in a mating cylindrical recess of the upper interior of the barrel extension 20, (see FIGS. 4 and 5) although other modifications described below make it clear that the port cover can be positioned in a mating cylinder recess of the upper interior of a firearm receiver 44 (see FIGS. 7 and 8). The port cover is restrained from longitudinal movement by abutment surfaces 46 and 48 on the barrel extension at the front and rear of the port cover. Rotary motion of the port cover is caused by the action of cam pin 40 located on bolt carrier as it moves longitudinally, acting on the port cover cam track 42.

It is noted that in FIG. 1 the cam pin 40 that moves in cam track 42 to rotate the port cover is the same cam pin that moves in the cam slot (not shown) in the bolt to rotate locking lugs 37 of bolt head 38 (see FIG. 3A) into and out of locking position with locking lugs 50 (see FIG. 3) on the barrel extension or the receiver, whichever is used. However, it should be clear that these two functions are distinct and separate. First of all, the invention can be used in a system where the breech bolt does not rotate. Secondly, the cam pin that cooperates with the port cover cam track to rotate the port cover can be mounted on the bolt carrier, as shown, or it could be fixed to any of the reciprocating parts within the receiver, such as the action bars, or bolt. The port cover is shown as a single part. However, it can be made of two pieces and the cam track can be a separate member which is attached by some means to the port cover. Obviously, these variations permit some flexibility in the manufacture of the parts.

Figure 15:
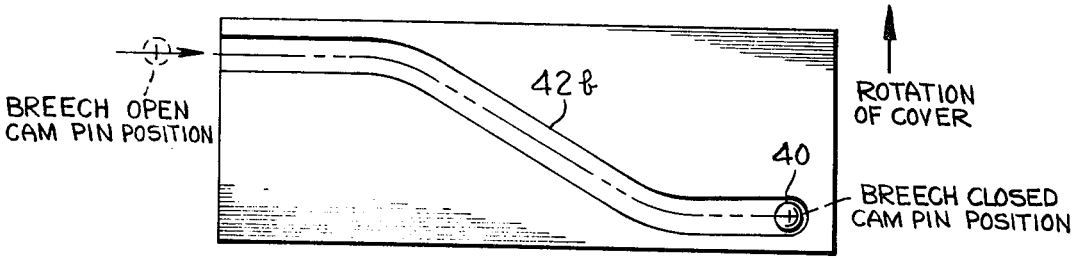
FIG. 15 is a schematic view of a port cover showing an alternative embodiment in which the cam track stops short of the forward edge of the port cover and the cam pin shown in breech closed position.

In the embodiment shown in FIG. 3, the length of the port cover is somewhat less than the full longitudinal stroke of the bolt assembly so that provision must be made for aligning the cam track 42 with the cam pin 40 at the forward end and at the rear end of the port cover. FIG. 3 shows the port cover in its "open port" position wherein the cam pin 40 would be positioned rearwardly of the port cover and aligned. with a cam pin clearance groove 52 shown at the left side of FIG. 3 (the rear of the barrel extension). Cam pin clearance groove 52 is cut on the inside surface of the barrel extension. The groove 52 extends rearwardly from the rear end of the port cover to the rear end of the barrel extension. From FIGS. 4 and 5, it can be seen that detent notches 54 and 56 are cut into the barrel extension or receiver interior surface in predetermined positions. A cantilever, leaf-spring detent 58 formed outwardly in a radial direction in said port cover can engage said detent notches to position and align the port cover in either the closed port position (FIG. 4) or the open port position (FIG. 5). When the port cover detent 58 engages detent notch 54, as shown in FIG. 4, the port hole 28 is covered and the cam pin 40 is positioned forwardly of the port cover in a groove defined by lugs 50 but aligned with the forward open end of the cam track 42 so it can move into the cam track upon rearward movement of the bolt assembly. Conversely, when the spring detent 58 engages detent notch 56, as shown in FIG. 5, the port hole 28 is uncovered and the cam pin 40 is positioned rearwardly of the port cover but aligned with the rear open end of groove 52, which in turn is aligned with the rear open end of the cam track 42 on the port cover 30.

Where conditions do not require the reciprocating stroke of the bolt-carrier assembly to override both the front and rear ends of the port cover, as shown in FIG. 3, alternative embodiments are possible. FIG. 15 shows a cam pin 40 engaging cam track **42*b* at breech closed position. The cam track 42*b* does not run to the forward edge of the port cover while it does run past the rear edge so that the cam pin 40 is disengaged from the cam track 42*b* at breech open position. In FIG. 15**, the cam pin is engaging the cam track before rearward reciprocating motion of the bolt carrier begins. During this motion, the port cover rotates to an open position whereupon the cam pin leaves the cam track prior to reaching the breech open position.

Figure 16:
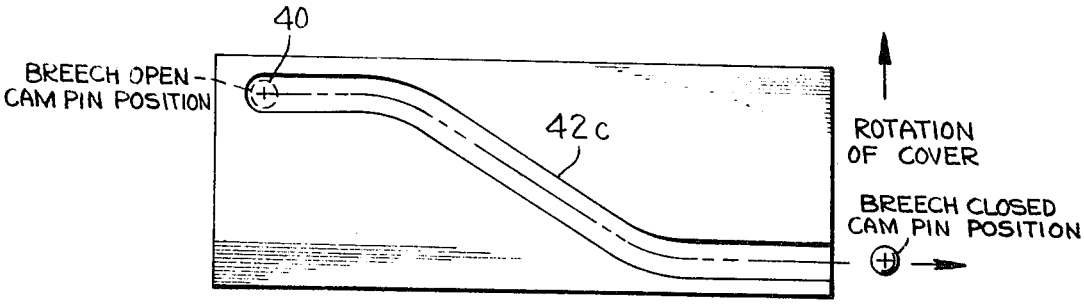
FIG. 16 is a schematic view of a port cover showing another alternative embodiment in which the cam track stops short of the rear edge of the port cover and the cam pin shown in breech open position.

FIG. 16 shows another alternative embodiment where the cam pin 40 engages the cam track **42*c* at breech open position but is disengaged from the cam track 42*c* at breech closed position. The cam pin is initially disengaged from the cam track at the breech closed position prior to beginning reciprocating motion of the bolt carrier. During this motion, the cam pin picks up engagement with the cam track and maintains engagement through port cover opening phase and into breech open position. At breech open position, the pin is at the rear end of cam track 42*c*, as shown in FIG. 16**.

It should be noted that where the cam pin 40 does not leave the port cover, such as the breech closed position of FIG. 15 and the breech open position of FIG. 16, the cam pin acts as a detent, although detent means 54 (or 56) can be used, they need not be used. When the cam pin leaves the port cover, as in the breech open position of FIG. 15 and the breech closed position of FIG. 16, a detent means such as 56 (or 54) is necessary to properly orient the port cover.

It should be noted that the embodiments of the cam track described above have the cam track cut, molded, or generally formed in or on the inside surface of the port cover. The cam pin engages the cam track but it does not extend through the port cover, as in the Alday patent. The cam motion chosen to give the required smooth rotational movement to the port cover provides a uniformly accelerated and retarded motion. The cam track consists of an entry straight dwell, a uniformly accelerated and retarded motion cam and an exit straight dwell. This design permits a relatively large degree of rotation because the cam pin does not extend through the port cover and the cam track can occupy the major portion of the width of the port cover.

Also shown in FIGS. 4 and 5 is a port cover retaining rail 60, which is a structural member that lies longitudinally in the top of the receiver 44 (or barrel extension 20) to retain the port cover in a radial position, countering the port cover detent spring 58. The port cover retaining rail 60 can be mounted to the receiver (or barrel extension) in front of and to the rear of the port cover in several ways.

Figure 7:
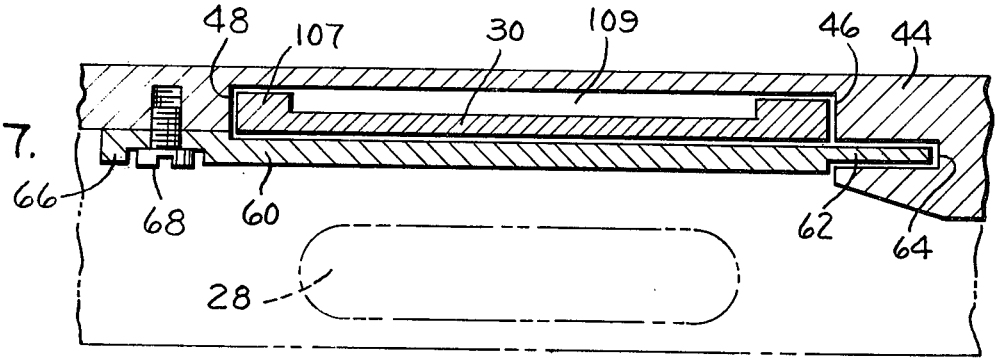
FIG. 7 is a sectional elevation view showing one method of mounting a port cover retaining rail to a conventional hollow form of firearm receiver.

A simple means of mounting the port cover retaining rail 60 to the receiver 44 to restrain a port cover 30 is shown in FIG. 7. The front end 62 of the rail 60 is restrained by an undercut 64 in the receiver, while the rear end 66 is simply held to the inside top of the receiver with a screw fastener 68. This method of attachment may be used in any conventional receiver of the hollow, enclosed type.

Figure 8:
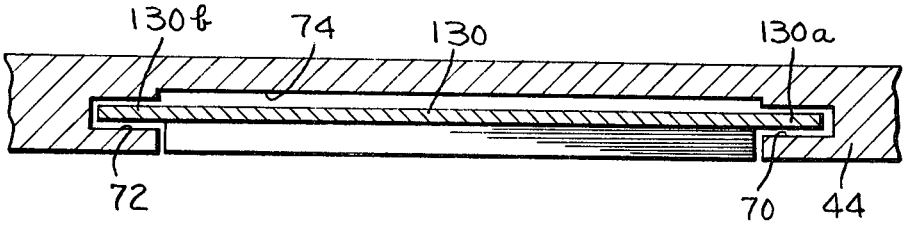
FIG. 8 is a sectional elevation view showing another method of retaining a rotatable port cover in a hollow receiver from without using a port cover retaining rail.

Another means of retaining the port cover in a hollow recevier form is shown in FIG. 8. In this design, the port cover 130 is held in position against the inside of the receiver 44 by undercut surfaces 70 and 72 machined in the hollow inside cylinder surface of the receiver. The port cover 130 must enter these undercuts 70 and 72 in a cylinder-within-a-cylinder fashion for assembly. This design does not require a port cover retaining rail. A deepened cylindrical recess 74 is provided between the port cover 130 and the receiver 44 to act as a debris clearance zone. The end portions **130*a* and 130*b* of the port cover 130 act as bearing surfaces and move in undercut surfaces 70 and 72** of the receiver.

The retaining rail designs described above can be readily adapted for use in most receivers of the conventional hollow form. In the case of a break open firearm, which requires access to the port cover zone from the rear — as when the port cover is mounted in the separable barrel extension, other methods of mounting the retaining rail are possible.

Figure 10:
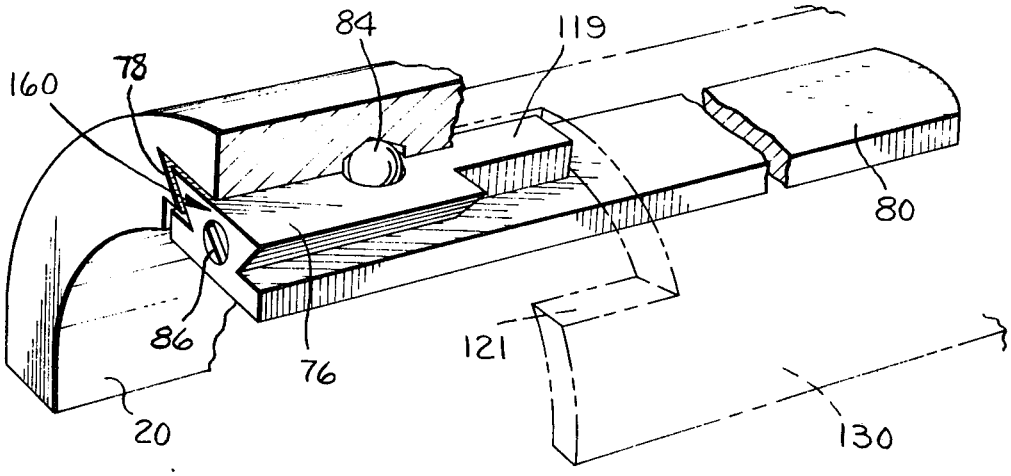
FIG. 10 is an isometric view of a design for mounting the port cover retaining rail which requires access to the port cover zone from the rear, as when the port cover is mounted in the separable barrel extension shown in FIG. 1.
Figure 11:
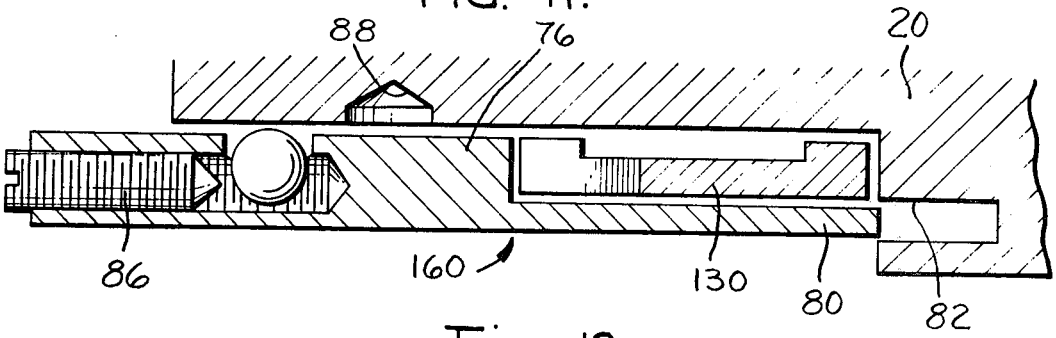
FIG. 11 is a sectional side view of an intermediate step in the retaining rail installation of FIG. 10, i.e. prior to engagement of the retaining rail with the barrel extension.
Figure 12:
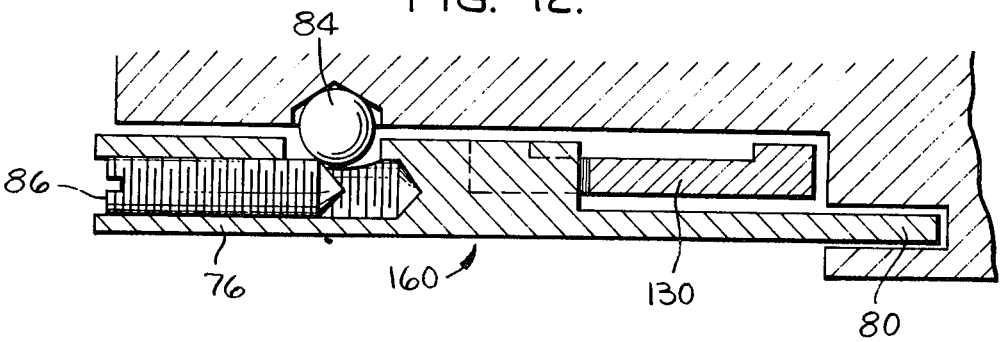
FIG. 12 is a cross-sectional view similar to FIG. 11 except that the retaining rail has been moved and locked in the forward, barrel extension engaging position.

One design for mounting a retaining rail in such cases is shown in FIGS. 10–12. In this design the port cover retaining rail 160 is slid forwardly into position over the port cover 130. The rear end 76 of the port cover retaining rail 160 is in the form of an inverted dovetail which engages a mating cut 78 in the barrel extension 20 to locate the rail vertically. The forward end 80 of rail 160 engages and is restrained vertically and laterally by an undercut 82 machined in the barrel extension 20. FIG. 11 shows the dovetail portion 76 of the retaining rail partially engaged, with initial engagement of the forward nose of the rail in the undercut. FIG. 12 shows the retaining rail moved to its forward position so as to be restrained vertically and laterally. Within the rear dovetail part 76 of the retaining rail 160 is located a steel ball 84 and threaded member 86 which serve to lock the rail into position in the longitudinal direction. When the rail is in the forwardmost position, rotation of the threaded member 86 moves it forward relative to the rail to cam the ball 84 vertically into a conical recess 88 in the barrel extension. The wedging effect of the conical nose of the threaded screw on the ball tends to force the rail downward, thereby tightening the dovetail joint. In the assembled position shown in FIG. 12, the ball is located half in the retaining rail and half in the barrel extension, acting as a member in shear, thereby preventing longitudinal movement of the retaining rail. This type of ball/- screw device is not uncommon in the design of fixtures, etc.

Figure 13:
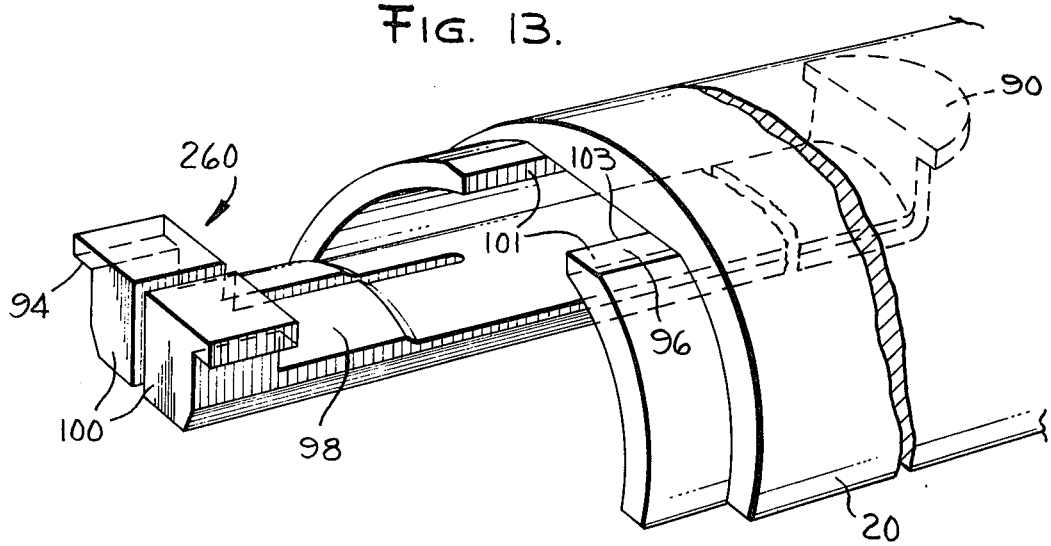
FIG. 13 is an isometric view of a preferred design for retaining a port cover retaining rail in a barrel extension.
Figure 14:
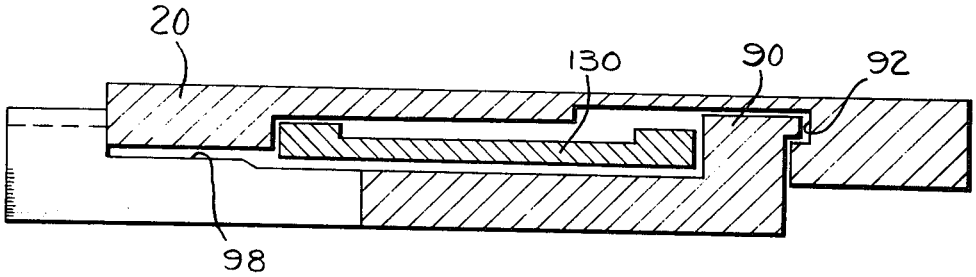
FIG. 14 is a sectional side view of the retaining rail mounting means shown in FIG. 13.

A second and preferred design for holding a port cover retaining rail in a barrel extension is shown in FIGS. 13 and 14. The retaining rail 260 is assembled by moving it forward to slidably engage several surfaces on the barrel extension. At the front, the nose 90 of the retaining rail 260 simply engages an undercut 92 in the barrel extension 20 and thereby is restrained vertically and laterally. At the rear, vertical restraint is provided by engagement of surfaces in two areas. One area is the underside of the laterally projecting ears 94 which extend laterally over the horizontal barrel extension surfaces 96 thus preventing downward movement of the rail. The second area is where the top surface 98 of the retaining rail 260 liees under the barrel extension to prevent movement of the rail upward, thereby controlling the clearance for rotation of the ejection port cover 130.

Semipositive longitudinal retention of the port cover retaining rail in the barrel extension is provided by the frictional force caused as the rear split end 100 of the retaining rail is slightly compressed in a lateral direction between the vertical surfaces 101 of a longitudinally extending groove 103 in the barrel extension, see FIG. 13. This is acceptable to prevent accidental disassembly of the retaining rail and port cover when the barrel assembly is not mounted on the frame. When the barrel assembly is in the closed position, i.e. locked to the frame as shown in FIG. 2, a fixed abutment (not shown) on the top lock mechanism 105 is positioned directly behind the port cover retaining rail, thereby preventing any longitudinal movement of the rail (which) may bind the port cover) caused by reciprocating parts within the receiver bearing on the rail.

Figure 6A:
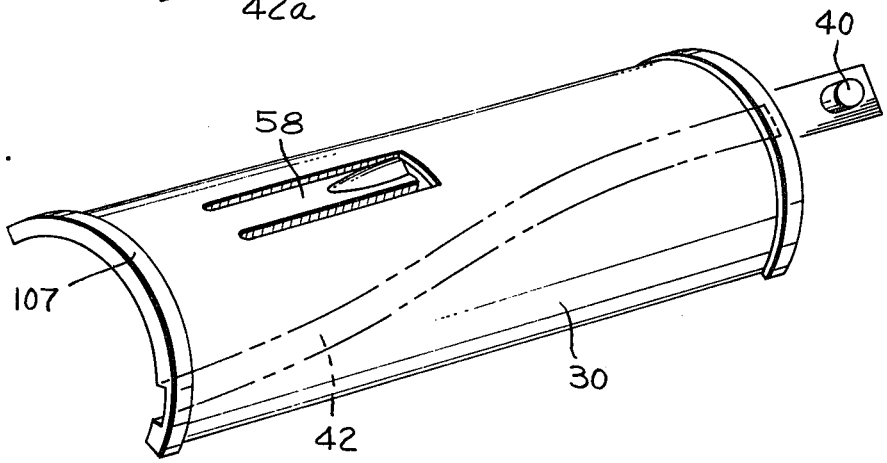
FIG. 6A is an isometric view of a port cover similar to the one shown in FIG. 6 except that the cam track is of the female type and the cam pin is a male type.

The port cover cam pin and port cover cam track can be made in a variety of ways. FIG. 3A and FIG. 6A show a male form of cam pin 40 projecting into a recessed (female) cam track 42 in the port cover. FIG. 6 shows the cam pincam track arrangement of FIG. 1 wherein a female form of cam pin 40*a* acts on a male form of cam track 42*a.* The most important feature of either cam track design is that it provides for complete rotation of the port cover at the lowest stress level; that is, the cam pin-cam track arrangement should accelerate and decelerate the port cover as smoothly as possible.

It should be noted here that any of the port cover forms discussed above may be made with bearing surfaces 107 between which is a reduced diameter surface, the debris clearance space 109 (see FIG. 7). If the bearing surfaces 107 are designed to be in front of and to the rear of the ejection port opening 28 by some margin, then surface dust or debris will have less opportunity to foul the bearing surfaces and can occupy the debris clearance space without bearing on and marring the surface of the port cover.

Figure 9:
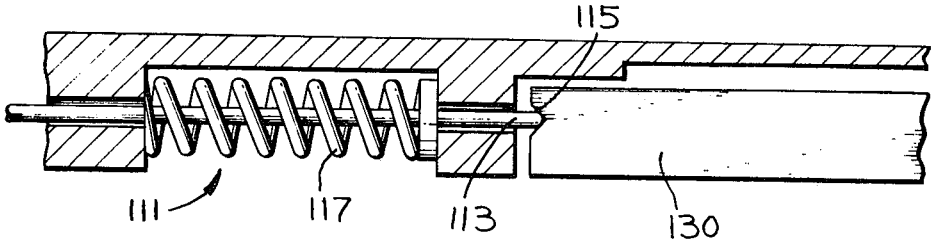
FIG. 9 is a sectional elevation view of an alternate method of detenting the rotational position of the ejection port cover to the firearm receiver.

Several means of detenting the rotational position of the port cover may be used in place of the port cover detent spring 58 (see FIGS. 4–6). One detent means used successfully with a port cover 130 as in FIG. 8 is the spring plunger 111 as shown in FIG. 9. The plunger 113 is biased into engaging position with radial notch 115 of port cover 130 by means of a helical compression spring 117.

One feature that can be incorporated into any of the port cover retaining rail designs is a positive means of limiting port cover rotation. As shown in FIG. 10, a portion of the retaining rail 160 can be extended into the rotative zone of the port cover 130 to form the retaining rail stop lug 119. As the port cover rotates in normal operation, this lug 119 lies within the port cover segment cut 121 to positively limit the rotation of the port cover.

In summary, the rotational port cover described above provides the following features:

1. Coverage of the ejection port is as good or better than existing slidable port cover designs;

2. a pleasing appearance of the closed port opening is maintained because the cylindrical surface of the port cover blends well with the top radius typically machined on the receiver. Because the port opening can be completely closed by the cover, irregular lines which would detract from the appearance are also eliminated;

3. positive retention in the upper receiver or barrel extension simplifies the assembly/disassembly of the firearm and prevents loss of the port cover; the detent which positions the port cover rotationally allows for a short port cover design, extending only slightly longer than the length of the port opening. Specifically, a detent allows the bolt mechanism (cam pin) to disengage and engage the port cover;

4. the gradual cam track provides inherently smoother operation and less failure than one with a mechanical disadvantage. Also, because a relatively low stress level can be maintained, the use of plastic materials for the port cover may be considered;

5. the debris clearance zone provides space for debris which may foul operation or mar the exterior surface of the cover; and 6. the compact nature of the rotary port cover permits its use in a shotgun providing the same measure of protection from debris in semiautomatic or slide-action type shotguns that is commonplace in center fire rifles.

What is claimed is:

1. In an ejection port covering mechanism for a reciprocating action firearm comprising: a hollow receiver having an ejection port therein, a bolt assembly slidably mounted in said receiver to move from a breech closed position to a breech open position, a port cover for covering said ejection port when the bolt assembly is in the breech closed position and which uncovers the port when the bolt assembly is retracted from the breech closed to the breech open position, the improvement comprising:

means for supporting said port cover in said receiver to prevent longitudinal movement while permitting rotational movement of the port cover relative to said receiver, cam means on said bolt assembly engaging cam means on said port cover during a portion of the longitudinal stroke of said bolt assembly for rotating said port cover into port closed position when the bolt assembly is moved forwardly into the breech closed position, said cam means on said bolt assembly moving a greater distance longitudinally than the length of the port cover so that the bolt assembly cam means moves out of the port cover cam means at least at one end of said port cover, and means for retaining said port cover cam means in proper alignment with said bolt assembly cam means when the bolt assembly cam means is positioned outside of said port cover cam means.

2. In an ejection port covering mechanism as recited in claim 1 wherein said bolt assembly cam means comprises an outwardly extending protuberance on said bolt assembly.

3. In an ejection port covering mechanism as recited in claim 2 wherein said port cover cam means comprises a cam track which is gradually inclined through substantially the length of the port cover so as to provide smooth rotational operation of the port cover.

4. In an ejection port covering mechanism as recited in claim 2 wherein said port cover cam means comprises a curved cam track formed on the inside surface of said port cover to provide for uniform acceleration and deceleration of the port cover when being moved to the port open and port closed positions.

5. In an ejection port covering mechanism as recited in claim 1 wherein said bolt assembly cam means comprises a pin means and said bolt cover cam means comprises a curved cam track formed on the inside surface of said port cover, one of said cam means comprising a male member and the other of said cam means comprising a female member whereupon said cam means are slidably and operably engaged in one another to rotate said port cover upon reciprocation of the bolt assembly.

6. In an ejection port covering mechanism as recited in claim 1 wherein said means for retaining said port cover cam means in proper rotational alignment with said bolt assembly cam means comprises a cantilever leaf spring formed from the port cover which engages at least one detent cut made in the hollow inside surface of said receiver.

7. In an ejection port covering mechanism as recited in claim 1 wherein said means for retaining said port cover cam means in proper rotational alignment with said bolt assembly cam means comprises a spring biased plunger mounted longitudinally in said receiver to engage detent means formed on an end surface of said port cover.

8. In an ejection port covering mechanism as recited in claim 1, a port cover retaining rail mounted longitudinally on said receiver to position the port cover between the retaining rail and the receiver so as to retain the port cover in a radial position.

9. A firearm having a hollow receiver in which a bolt assembly reciprocates from a rear, breech open position to a forward, breech closed position, an ejection port in said receiver, a port cover mounted in said receiver, means restraining longitudinal movement of said port cover relative to said receiver while permitting rotational movement into and out of ejection port covering position, cam pin means on said bolt assembly, corresponding cam track means on said port cover, said pin means and said cam track means cooperating to cause rotational movement of said port cover during a portion of the total reciprocating stroke of said bolt assembly, said port cover being shorter in length than the length of stroke of said cam pin means so as to permit a compact port cover which is slightly longer than said ejection port.

10. A firearm as recited in claim 9 wherein said cam track means is formed on the inside surface of said port cover, at least one end of said cam track means extending to one of the ends of said port cover so that the cam pin means can move off said port cover to a second cam track portion formed in said receiver and aligned with said port cover cam track means.

11. A firearm as recited in claim 9 in which a port cover retaining rail is mounted longitudinally on said receiver to retain the port cover in a radial position.

12. A firearm as recited in claim 11 wherein said port cover retaining rail has its forward end positioned in an undercut in the receiver and the rear end is connected to the receiver by a removable connecting means.

13. A firearm as recited in claim 12 wherein means are provided on said retaining rail and said port cover for positively limiting port cover rotation.

14. A firearm as recited in claim 13 in which said means for limiting port cover rotation comprises a stop lug on said retaining rail which extends into the rotative zone of the port cover and a segment cut in said port cover whereupon as the port cover rotates in normal operation, said stop lug moves within said segment cut to positively limit the rotation of said port cover.

15. A firearm as recited in claim 12 wherein said port cover comprises bearing surfaces at the ends thereof, said bearing surfaces being separated by a reduced diameter surface thus forming a cavity for debris clearance.

16. A firearm as recited in claim 9 wherein said port cover comprises bearing surface end portions which are held in position against the inside of the receiver by undercut surfaces machined in the hollow cylinder surface of the receiver, said port cover end portions entering said undercuts in a cylinder-within-a-cylinder fashion for assembly.

17. A firearm as recited in claim 16 wherein the receiver surface between said undercut surfaces and adjacent the outer surface of said port cover is recessed, thus forming a cavity for debris clearance.

18. A firearm as recited in claim 9 having means for keeping the port cover aligned for entry of said cam pin means into said cam track means.

19. A firearm as recited in claim 18 wherein said cam track is formed in a continuous curve on the inside surface of the port cover.

20. A firearm as recited in claim 19 wherein said means for keeping the port cover aligned for entry of said cam pin means into said cam track means comprises a cantilever leaf spring formed from the port cover which engages detent means made in the hollow inside surface of said receiver.

21. A firearm as recited in claim 19 wherein said means for keeping the port cover aligned for entry of said cam pin means into said cam track means comprises a spring biased plunger mounted longitudinally in said receiver to engage detent means formed on an end surface of said port cover.

22. A break open firearm in which a barrel assembly is hinged to a frame so that when unlatched, the barrel assembly and frame can pivot relative to each other from a closed position to a break open position, said barrel assembly comprising a barrel extension at its breech end, said barrel extension and said frame cooperating to form a hollow receiver in which a bolt assembly is slidably mounted to reciprocate from a rear breech open position to a forward breech closed position, an ejection port in said barrel extension, a port cover for covering said ejection port when the bolt assembly is in the breech closed position, means on said barrel extension for restraining longitudinal movement of said port cover relative to said barrel extension while permitting rotational movement, cam pin means on said bolt assembly engaging cam track means on said port cover during a portion of the longitudinal stroke of said bolt assembly for rotating said port cover to cover or uncover the ejection port depending on whether the bolt assembly is moving forwardly or rearwardly, and means for retaining said cam track means in proper alignment with said cam pin means when said cam pin means is moved out of said cam track means.

23. A break open firearm as recited in claim 22 wherein said port cover cam track means comprises a shaped curve formed in the inside surface of said port cover and extending substantially the full length of said port cover.

24. A break open firearm as recited in claim 22 in which one of said cam pin means and cam track means comprises a male portion and the other of said cam pin means and cam track means comprises a female portion whereupon said cam means are slidably and operably engaged in one another to rotate said port cover upon reciprocation of said bolt assembly.

25. A break open firearm as recited in claim 23 wherein said means for retaining said port cover cam track means in proper alignment comprises a spring means on said port cover and at least one corresponding detent means on the inside wall of said barrel extension into which said spring means can move to retain said port cover in a specified open or closed position.

26. A break open firearm as recited in claim 23 in which an elongated port cover retaining rail is mounted longitudinally on said receiver so as to contain the port cover between the retaining rail and the inside wall of the barrel extension, said retaining rail retaining said port cover in a radial position while permitting the port cover to rotate into and out of ejection port closing position.

27. A break open firearm as recited in claim 26 wherein the forward end of said retaining rail engages an undercut in the barrel extension to restrain said rail vertically and laterally, means on the rear end of said retaining rail cooperating with corresponding means on the rear end of said barrel extension to restrain upward and downward movement relative to said barrel extension while providing frictional engagement therewith to prevent accidental disassembly of said rail and port cover when said barrel extension is not mounted on said frame.

28. A break open firearm as recited in claim 27 wherein said means on the rear end of said retaining rail comprises laterally projecting ears which extend over a horizontal barrel extension surface and a top rail surface which lies under the barrel extension thus preventing vertical movement of said retaining rail, said retaining rail rear end being split so as to be capable of being contracted and inserted into a groove in the end of said barrel extension so as to be frictionally retained therein.

29. A break open firearm as recited in claim 26 wherein means are provided on said retaining rail and said port cover for positively limiting port cover rotation.

30. A break open firearm as recited in claim 29 in which said means for limiting port cover rotation comprises a stop lug on said retaining rail which extends into the rotative zone of the port cover, a segment cut in said port cover, whereupon as the port cover rotates in normal operation, said stop lug moves within said segment cut to positively limit the rotation of said port cover.

31. A break open firearm as recited in claim 22 wherein said port cover comprises end portions which are held in position against the inside of the barrel extension by undercut surfaces machined in the hollow cylinder surface of the barrel extension, said port end portions entering said undercuts in a cylinder-within-a-cylinder fashion for assembly.

* * * * *

UNITED STATES PATENT AND TRADEMARK OFFICE

CERTIFICATE OF CORRECTION

PATENT NO. : 4,044,487

DATED : AUGUST 30, 1977

INVENTOR(S) : JAMES C. HUTTON, ET AL

It is certified that error appears in the above-identified patent and that said Letters Patent are hereby corrected as shown below:

Col. 7, Line 16, "liees" should read as "lies". Col. 12, Line 32, after port insert --cover--.

Signed and Sealed this

*Sixth* Day of *December 1977*

[SEAL]

*Attest:*

RUTH C. MASON
*Attesting Officer*

LUTRELLE F. PARKER
*Acting Commissioner of Patents and Trademarks*